US006815895B2

(12) United States Patent
Hirao

(10) Patent No.: US 6,815,895 B2
(45) Date of Patent: Nov. 9, 2004

(54) ULTRA-HIGH PRESSURE MERCURY LAMP

(75) Inventor: Tetsuji Hirao, Takasago (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 37 days.

(21) Appl. No.: 10/309,081

(22) Filed: Dec. 4, 2002

(65) Prior Publication Data

US 2003/0102807 A1 Jun. 5, 2003

(30) Foreign Application Priority Data

Dec. 5, 2001 (JP) ..... 2001-371834

(51) Int. Cl.[7] ..... H01J 61/00

(52) U.S. Cl. ..... 313/637; 313/638; 313/639; 313/567

(58) Field of Search ..... 313/567, 571, 313/576, 637, 638, 639, 642

(56) References Cited

U.S. PATENT DOCUMENTS 4,594,529 A * 6/1986 de Vrijer ..... 313/571
5,109,181 A 4/1992 Fischer et al.
5,594,302 A * 1/1997 Yakub et al. ..... 313/642
6,271,628 B1 8/2001 Sugitani et al.

FOREIGN PATENT DOCUMENTS

JP 11-297268 * 10/1999 ..... H01J/61/20
JP 2000-123786 4/2000
JP 2001-319618 11/2001

* cited by examiner

*Primary Examiner*—Nimeshkumar D. Patel
*Assistant Examiner*—Sharlene Leurig
(74) *Attorney, Agent, or Firm*—Nixon Peabody LLP; David S. Safran

(57) ABSTRACT

To devise an ultra-high pressure mercury lamp in which even in the case of lamp operation over a long time devitrification of the light emitting part is suppressed, an ultra-high pressure mercury lamp with a silica glass light emitting part in there is a pair of opposed electrodes, a rare gas, a halogen and at least 0.15 mg/mm$^3$ of mercury, by the amount of halogen in the light emitting part being at least $1.0\times10^{-4}$ $\mu$mol/mm$^3$ and the amount of Mo in the light emitting part being at most $0.5\times10^{-5}$ $\mu$mol/mm$^3$. Also, such a lamp can have an amount of halogen in the light emitting part of at least $2.0\times10^{-4}$ $\mu$mol/mm$^3$ with an amount of Mo of at most $1.0\times10^{-5}$ $\mu$mol/mm$^3$.

2 Claims, 4 Drawing Sheets

| Br amount \ Mo amount | 0.5 $\times 10^{-5}$ μmol/mm$^3$ | 1.0 $\times 10^{-5}$ μmol/mm$^3$ | 2.0 $\times 10^{-5}$ μmol/mm$^3$ | 6.0 $\times 10^{-5}$ μmol/mm$^3$ |
|---|---|---|---|---|
| 0.7 $\times 10^{-4}$ μmol/mm$^3$ | △ | × | × | × |
| 1.0 $\times 10^{-4}$ μmol/mm$^3$ | ○ | × | × | × |
| 2.0 $\times 10^{-4}$ μmol/mm$^3$ | ◎ | ○ | △ | × |
| 25.0 $\times 10^{-4}$ μmol/mm$^3$ | ◎ | ◎ | △ | △ |

Relation between the amount of Mo in the arc tube and the devitrification area

ULTRA-HIGH PRESSURE MERCURY LAMP

BACKGROUND OF THE INVENTION

1. Field of the Invention

The invention relates to an ultra-high pressure mercury lamp of the short arc type in which the mercury vapor pressure during operation is 15 MPa to 20 MPa. The invention relates especially to an ultra-high pressure mercury lamp which is used as the light source of a liquid crystal display device and a DLP® projector device (Texas Instruments: digital light processing) using a DMD (digital mirror device).

2. Description of the Prior Art

A high pressure discharge lamp, such as an ultra-high pressure mercury lamp or the like, has been used recently as the light source of a projector device of a liquid crystal projector device or the like, in which at least 0.15 mg/mm$^3$ of mercury is added as the emission substance and in which the operating pressure during operation is, for example, 15 MPa to 20 MPa, and therefore, is higher than in other types of discharge lamps.

In such a high pressure discharge lamp, the light emitting part which forms a discharge space in which there are opposed tungsten discharge electrodes, is filled with halogen together with emission substances, such as an inert gas, mercury, and the like, in order to prevent the phenomenon of devitrification as a result of blackening of the envelope and as a result of milky opacification of the envelope of this light emitting part or a similar phenomenon from occurring.

The process of hermetic sealing in the above described high pressure discharge lamp is advantageously a shrink seal method in which the inside of, for example, a silica glass tube, which has a light emitting part and sealing parts, is exposed to a negative pressure. The outer periphery of the respective sealing part of this silica glass tube, in this state, is heated by means of a torch or the like. The diameter of the silica glass comprising the envelope of this sealing part is reduced by softening. In this way, hermetically sealed parts are formed.

The above described high pressure discharge lamp generally does not have any residue of an outlet tube in order to ensure intensity of pressure tightness in lamp operation. Mo (molybdenum) material is used for metal foils and outer lead pins of the sealing parts.

The halogen introduced into the light emitting part is added, for example, according to the disclosure in Japanese patent disclosure document HEI 2-148561 (U.S. Pat. No. 5,109,181) in the form of $CH_2Br_2$ and according to the disclosure in Japanese patent disclosure document HEI 11-297268 in the form of a metal halide. If the halogen is added in this form, at least one of the sealing parts is hermetically sealed in an atmosphere in which the halogen is present, since there should not be any residue of the outlet tube. The Mo present in the sealing parts reacts at the temperature used in the operation of hermetic sealing (roughly 1600° C.) with halogen (for example, Br (bromine)) or $O_2$ (oxygen) which remain in the sealing parts, and which remain as a compound, such as $MoBr_4$, $MoO_3$ or the like in the light emitting part.

Gradually, it was found by the research of the inventor and his employees that the Mo compounds which reach the light emitting part in this way adhere to the inside surface of the light emitting part and become the starting point of formation of lamp devitrification during several hours of operation because at the temperature of the light emitting part during lamp operation, it has a lower vapor pressure than W (tungsten) compounds. This means that, as a result of the fact that Mo compounds as the starting point produce devitrification and allow it to grow, the light flux of the lamp is greatly attenuated.

SUMMARY OF THE INVENTION

The primary object of the present invention is to devise an ultra-high pressure mercury lamp in which, even in the case of lamp operation over a long time, devitrification of the light emitting part is suppressed.

This object is achieved, according to a first aspect of the invention, in an ultra-high pressure mercury lamp in which, in a silica glass light emitting part, there is a pair of opposed electrodes and the light emitting part is filled with a rare gas, halogen and at least 0.15 mg/mm$^3$ of mercury, in that the amount of halogen in the light emitting part is at least $1.0\times10^{-4}$ $\mu$mol/mm$^3$ and that, moreover, the amount of Mo in the light emitting part is at most $0.5\times10^{-5}$ $\mu$mol/mm$^3$.

The object is achieved according to another aspect of the invention in an ultra-high pressure mercury lamp in which, in a silica glass light emitting part, there is a pair of opposed electrodes and the light emitting part is filled with a rare gas, halogen and at least 0.15 mg/mm$^3$ of mercury, in that the amount of halogen in the light emitting part is at least $2.0\times10^{-4}$ $\mu$mol/mm$^3$ and that, moreover, the amount of Mo in the light emitting part is at most $1.0\times10^{-5}$ $\mu$mol/mm$^3$.

The invention is further described below using one embodiment shown in the drawings.

DETAILED DESCRIPTION OF THE INVENTION

Figures 1, 2:
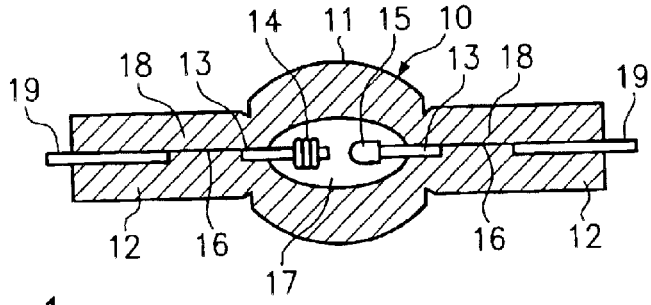
FIG. 1 is a schematic cross section of one example of the arrangement of a high pressure discharge lamp in accordance with the invention.
FIG. 2 is a table which shows the relation between the amount of Mo in the light emitting part, the amount of halogen added and the time at which devitrification begins.

FIG. 1 shows a schematic cross section of one example of the arrangement of a high pressure discharge lamp in accordance with the invention in which a high pressure mercury lamp has a discharge lamp vessel 10 with an oval light emitting part 11 and sealing parts 12 in the form of rod-shaped tubes which extend to the outward along the longitudinal tube axis from opposite ends of the light emitting part 11. In each light emitting part 12, a molybdenum metal foil 16 is hermetically installed, by which a hermetically sealed part 18 is formed.

In the discharge space 17 of discharge lamp vessel 10 which is surrounded by the light emitting part 11, a tungsten cathode 14 and a tungsten anode 15 are disposed in an opposed relationship to each other. The cathode 14 is formed on the tip of an inner lead pin 13 which projects inward from the inside edge of one of the metal foils 16 (on the left in the representation) along the longitudinal tube axis. The anode 15 is formed on the tip of the inner lead pin 13 which projects to the inside from the inside edge of the other metal foil 16 (on the right in the representation) in the direction of the longitudinal tube axis. The outer lead pins 19 are electrically connected to the outer end of the respective metal foil 16.

The discharge lamp vessel 10 which is formed from the light emitting part 11 and the sealing parts 12 is made, for example, of silica glass. This discharge lamp vessel 10 is filled with an emission substance such as, for example, mercury or the like, in a given added amount. When the high pressure discharge lamp with the arrangement shown in FIG. 1 is an ultra-high pressure mercury lamp with an operating pressure during operation of 15 MPa to 20 MPa, at least 0.16 $mg/mm^3$ of the inside volume of the light emitting part is filled with mercury, as is described, for example, in Japanese patent disclosure document HEI 10-111317 and corresponding U.S. Pat. No. 6,060,830.

In high pressure discharge lamps with the above described shape, the amounts of halogen (Br) present in the respective light emitting part and of the Mo present in the respective light emitting part were changed. Ten sample lamps per type were produced, and at an input power of 200 W, an uninterrupted operating test was run.

FIG. 2 is a table showing the types of lamps produced and the results of measurements of the time at which devitrification began. Here, the double-circle symbol shows that at roughly 1000 hours after the start of operation devitrification began, the circle symbol shows that devitrification began within 500 hours to 1000 hours, the triangle symbol shows that devitrification began within 200 hours to 500 hours, and the X symbol shows that devitrification began within 200 hours.

If the amount of halogen in the light emitting part of the lamp is at least $1.0\times10^{-4}$ $\mu mol/mm^3$, and moreover, if the amount of Mo in the light emitting part is at most $0.5\times10^{-5}$ $\mu mol/mm^3$, the time at which devitrification of the light emitting part begins can be delayed.

Also, in the case in which the amount of halogen in the light emitting part is at least $2.0\times10^{-4}$ $\mu mol/mm^3$, and moreover, if the amount of Mo in the light emitting part is at most $1.0\times10^{-5}$ $\mu mol/mm^3$, the time at which devitrification of the light emitting part begins can be delayed.

Figure 3:
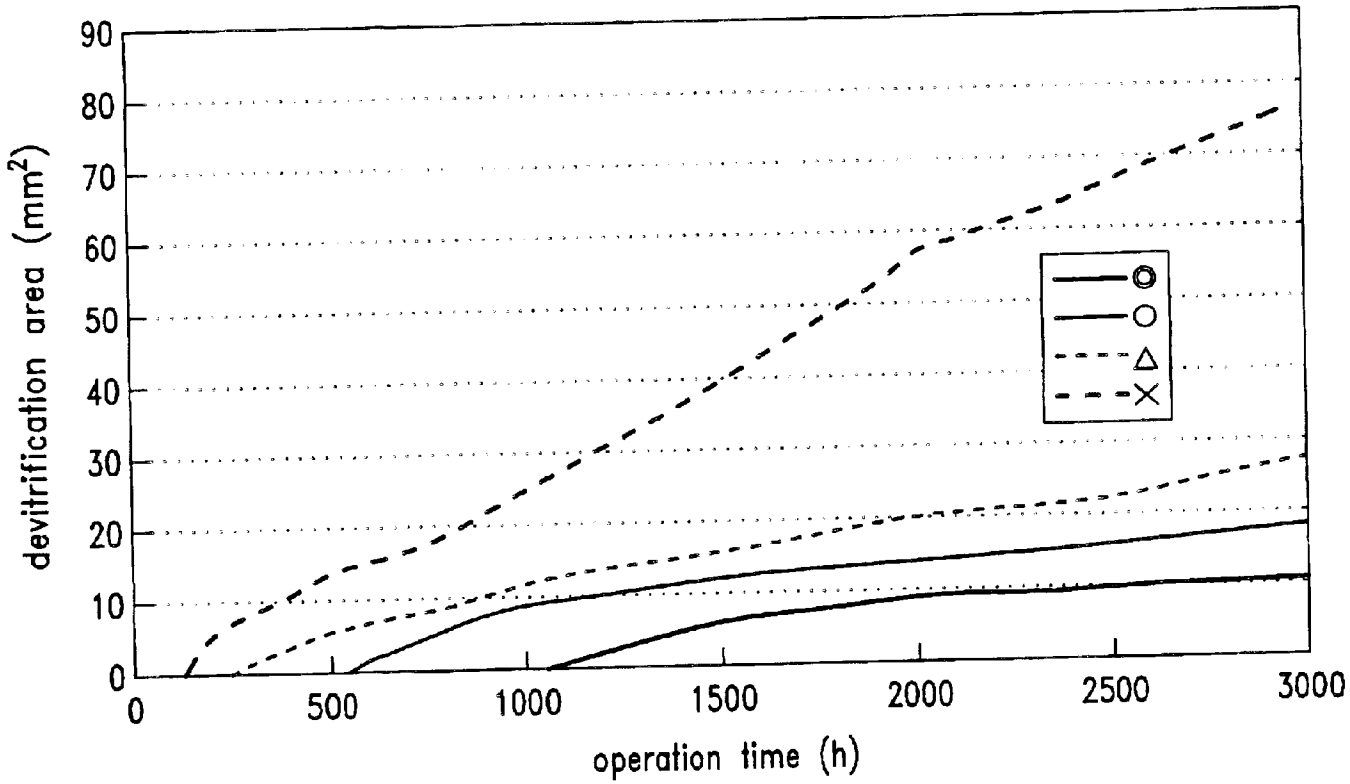
FIG. 3 is a graph plotting the relationship between the amount of Mo in the light emitting part and the devitrification area.

FIG. 3 shows the relationship between the amount of Mo in the light emitting part of the respective lamp and the devitrification area of the light emitting part. These lamps were produced in such a way that the amount of halogen in the light emitting part was constant at $2.0\times10^{-4}$ $\mu mol/mm^3$ and that the amount of Mo in the light emitting part was $0.5\times10^{-5}$ $\mu mol/mm^3$, $1.0\times10^{-5}$ $\mu mol/mm^3$, $2.0\times10^{-5}$ $\mu mol/mm^3$ or $6.0\times10^{-5}$ $\mu mol/mm^3$.

The double-circle symbol shows lamps with a Mo amount of $0.5\times10^{-5}$ $\mu mol/mm^3$ in which devitrification began at roughly 1000 hours. The circle symbol shows lamps with a Mo amount of $1.0\times10^{-5}$ $\mu mol/mm^3$ in which devitrification began after 500 hours to 1000 hours. The triangle symbol shows the lamps with a Mo amount of $2.0\times10^{-5}$ $\mu mol/mm^3$, in which devitrification began after 200 hours to 500 hours. The X symbol shows lamps with a Mo amount of $6.0\times10^{-5}$ $\mu mol/mm^3$ in which devitrification began at less than 200 hours.

In these tests, for each of the amounts added, data from ten lamps were determined. The double-circle symbol (Mo amount of $0.5\times10^{-5}$ $\mu mol/mm^3$) shows that in all ten lamps devitrification did not begin until at least 1000 hours. The circle symbol (Mo amount of $1.0\times10^{-5}$ $\mu mol/mm^3$) shows that in all ten lamps devitrification began within 500 hours to 1000 hours. For the double circle symbol and the circle symbol the degree to which the devitrification area increases after the start of devitrification decreases.

In the above described tests, the determination of the Mo amount in the light emitting part can be done, for example, using inductively coupled plasma emission spectroscopic analysis (ICP-MS method). This measurement principle is described below.

Emission spectroscopic analysis is performed with an excitation source which produces an inductively coupled plasma. A sample solution which has been atomized is introduced into an argon plasma with a high temperature. The emission spectrum lines are broken down spectroscopically by means of a diffraction grating with quantitative analysis and qualitative analysis of elements being performed based on the wavelengths and intensity of these spectral lines.

The features are the following:

Since the interference between the elements is low, rarely is an influence exerted by coexisting elements.

Since the range of the measurement concentration is wide (linearity is high), the area of the calibration curve can be low.

There is a high determination sensitivity with a ppb level.

Often, the above described process is generally used as a means for quantitative determination of an extremely small amount of metal.

Figure 4:
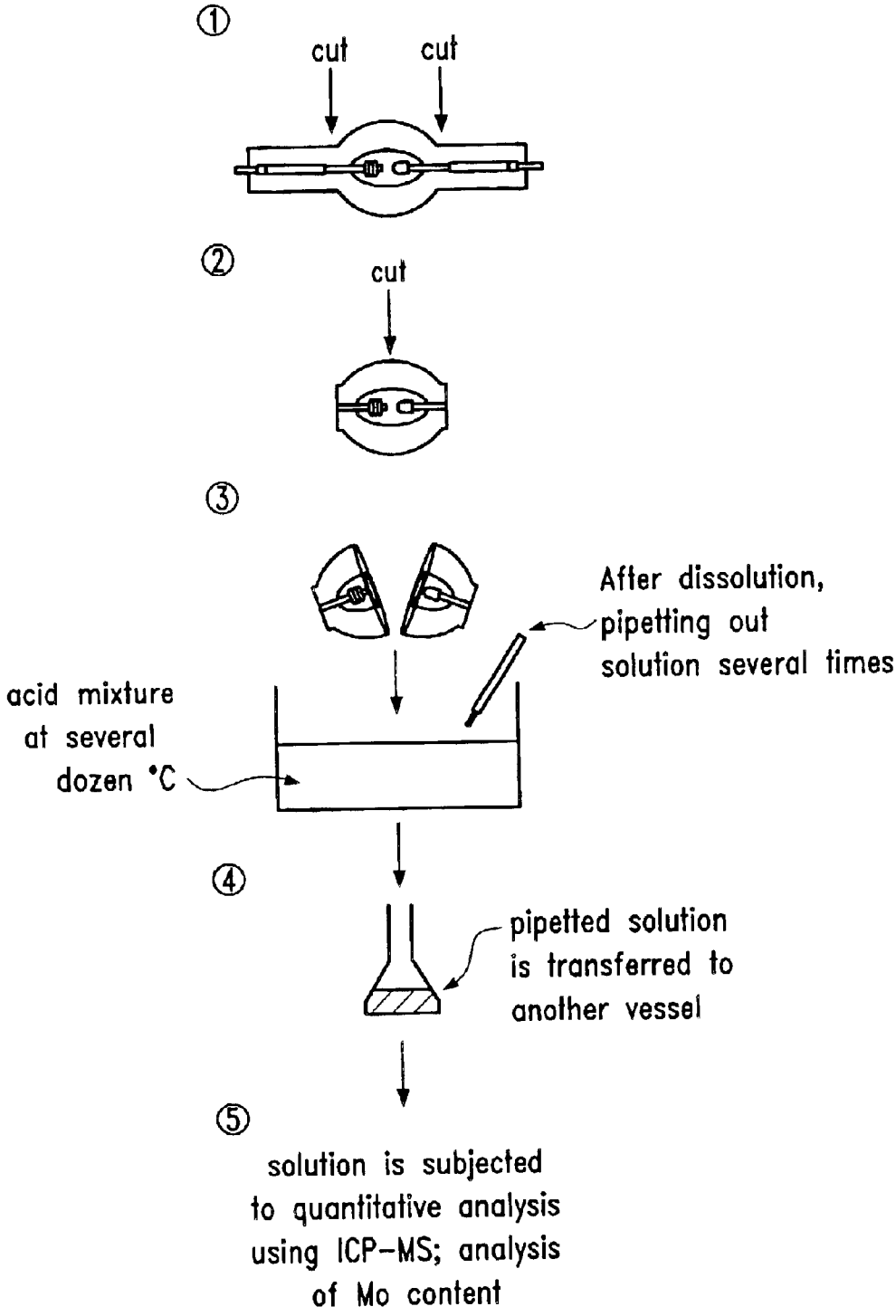
FIG. 4 shows a schematic of a process for determining the amount of Mo in the light emitting part.

FIG. 4 explains the process for determining the amount of Mo in a schematic as follows:

(1) The discharge lamp is cut off in the areas shown by the arrows, while the discharge space (light emitting part) is left.

(2) The light emitting part is cut in the middle and separated into two parts.

(3) These parts are placed in a mixed acid which consists of nitric acid and aqueous hydrogen peroxide and which has been heated to a few dozen degrees C. In this way, the Mo is dissolved. After dissolution, the solution is repeatedly suctioned.

(4) The suctioned solution is decanted into another vessel.

(5) The above described solution is subjected to quantitative analysis by the ICP-MS method, and thus, the amount of Mo is measured.

The process for producing an ultra-high pressure discharge lamp in accordance with the invention is described below, in which the amount of Mo in the light emitting part is fixed at an amount which is at most $1.0\times10^{-5}$ $\mu mol/mm^3$ and in which the amount of halogen in the light emitting part is fixed at a given amount.

Figure 5:
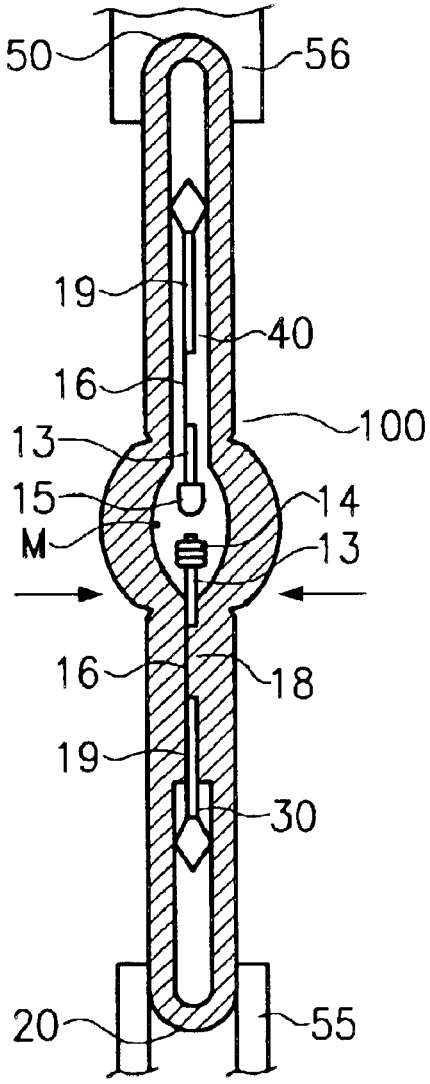
FIG. 5 is a schematic cross-sectional view of important parts in the process for producing the ultra-high pressure mercury lamp in accordance with the invention.

FIG. 5 is a schematic cross section of important parts in this production process. In the figure, a cathode arrangement 30 is formed by the outer lead pin 19, the metal foil 16 and the inner lead pin 13 in which the cathode 14 is formed. Furthermore, an anode arrangement 40 is formed by the outer lead pin 19, the metal foil 16 and the inner lead pin 13 in which the anode 15 is formed.

In one end of the tube 100 for forming the discharge vessel, a hermetically sealed part 18 is formed. After introducing gas for adding the halogen, sealing is completed so that a sealing area 50 is formed by a support component 56. By cooling part of the tube 100 (the area shown by the arrows in the figure) this gas is condensed for adding the halogen. In this state, on the side of the other end of the tube 100, another hermetically sealed part is formed.

It is desirable that liquid nitrogen be used as the cooling source for condensation of the gas for adding the halogen.

After the anode arrangement 30 and the gas for adding the halogen have been introduced into the tube 100 in which the hermetically sealed part 18 is formed, in the state in which the this gas is condensed, the other hermetically sealed part is formed. This prevents the metal foil 16 of the anode arrangement 40 from reacting with the halogen which originates from the gas introduced for adding the halogen.

Therefore, halogen in the desired amount can be added exactly to the light emitting part, and furthermore, impurities such as metal halides or the like which contain metal originating from the metal foil can be prevented from reaching the light emitting part 11. Also shown in the FIG. 5 is the emission substance M, the support component 55 and the sealing area 20.

By means of the above described production process, halogen is added exactly in the desired amount, and thus, the metal halide which contains metal from the metal foil can be prevented from reaching the light emitting part and damaging operation. As a result, a reduction in illuminance which occurs over time and which is caused by the phenomenon of devitrification as a result of blackening of the envelope and milky opacification of the envelope of the discharge lamp vessel or a similar phenomenon is suppressed. Therefore, an advantageous operating state can be maintained over a long time.

In the lamps which were used in the above describes tests and in which greater than $1.0\times10^{-5}$ $\mu$mol/mm$^3$ Mo is contained, using the added gases with different vapor pressures, the condensation conditions were changed and a given amount of halogen and a given amount of Mo were added. Furthermore, by changing the oxidation state of the metal foils also in the form of a Mo oxide the amount of Mo added is controlled.

In the embodiment of the invention, an ultra-high pressure mercury lamp of the direct current type which has a cathode and an anode is described by way of example. However, the action of the invention remains unchanged even for an ultra-high pressure mercury lamp of the alternating current type.

Action of the Invention

In the discharge lamp of the invention in which there is a pair of opposed electrodes in a silica glass light emitting part which is filled with a rare gas, a halogen and at least 0.15 mg/mm$^3$ mercury, the amount of halogen in the light emitting part is at least $1.0\times10^{-4}$ $\mu$mol/mm$^3$, and moreover, the amount of Mo in the light emitting part is at most $0.5\times10^{-5}$ $\mu$mol/mm$^3$. By this measure, an ultra-high pressure mercury lamp is obtained in which, in the case of lamp operation over a long time, devitrification of the light emitting part is suppressed.

Furthermore, the measure in accordance with the invention that the amount of halogen in the light emitting part is at least $2.0\times10^{-4}$ $\mu$mol/mm$^3$, and moreover, that the amount of Mo in the light emitting part is at most $1.0\times10^{-5}$ $\mu$mol/mm$^3$ yields a ultra-high pressure mercury lamp in which, in the case of lamp operation over a long time, devitrification of the light emitting part is suppressed.

What is claimed is:

1. Ultra-high pressure mercury lamp, comprising:

a silica glass light emitting part, a pair of opposed electrodes, a rare gas, and a halogen in said light emitting part, and an amount of mercury of at least 0.15 mg/mm$^3$ of inner volume of the light emitting part, wherein the amount of halogen in the light emitting part is at least $1.0\times10^{-4}$ $\mu$mol/mm$^3$, wherein molybdenum is present in the light emitting part in an amount less than or equal to $0.5\times10^{-5}$ $\mu$mol/mm$^3$.

wherein hermetically sealed parts extend from opposite ends of the light emitting part, and wherein a Mo foil to which a respective one of the electrodes is connected is sealed in each of the sealed parts.

2. Ultra-high pressure mercury lamp, comprising:

a silica glass light emitting part, a pair of opposed electrodes, a rare gas, and a halogen in said light emitting part, and an amount of mercury of at least 0.15 mg/mm$^3$ of inner volume of the light emitting part, wherein the amount of halogen in the light emitting part is at least $2.0\times10^{-4}$ $\mu$mol/mm$^3$, wherein molybdenum is present in the light emitting part in an amount less than or equal to $1.0\times10^{-5}$ $\mu$mol/mm$^3$.

wherein hermetically sealed parts extend from opposite ends of the light emitting part, and wherein a Mo foil to which a respective one of the electrodes is connected is sealed in each of the sealed parts.

* * * * *